US010757991B2

(12) United States Patent
Patz

(10) Patent No.: US 10,757,991 B2
(45) Date of Patent: Sep. 1, 2020

(54) EMBLEM AND ASSEMBLY FOR WEARABLE CLOTHING

(71) Applicant: Richard Patz, Katy, TX (US)

(72) Inventor: Richard Patz, Katy, TX (US)

(73) Assignee: Richard Patz, Katy, TX (US)

( * ) Notice: Subject to any disclaimer, the term of this patent is extended or adjusted under 35 U.S.C. 154(b) by 0 days.

(21) Appl. No.: 15/932,159

(22) Filed: Feb. 15, 2018

(65) Prior Publication Data

US 2019/0246719 A1 Aug. 15, 2019

Related U.S. Application Data

(60) Provisional application No. 62/458,072, filed on Feb. 13, 2017.

(51) Int. Cl.

| | |
|---|---|
| ***F21V 21/00*** | (2006.01) |
| ***A41D 27/08*** | (2006.01) |
| ***A41D 3/00*** | (2006.01) |
| ***A41D 13/00*** | (2006.01) |
| ***A41D 31/00*** | (2019.01) |
| ***A41D 1/00*** | (2018.01) |
| ***F21V 23/00*** | (2015.01) |

(Continued)

(52) U.S. Cl.

CPC ..... *A41D 27/085* (2013.01); *A41D 1/005* (2013.01); *A41D 3/00* (2013.01); *A41D 13/0007* (2013.01); *A41D 13/01* (2013.01); *A41D 31/00* (2013.01); *F21V 23/005* (2013.01); *A41D 2300/20* (2013.01); *A41D 2500/30* (2013.01); *A41D 2600/102* (2013.01); *F21Y 2115/10* (2016.08)

(58) Field of Classification Search

CPC ..... A41D 27/08; A41D 27/085; A41D 1/02; A41D 13/00; A41D 1/005; A41D 3/00; A41D 13/0007; A41D 13/01; A41D 2600/102; A41D 2300/20; F21V 23/005

USPC ..... 2/44, 69, 244, 246, 467; 40/625, 626, 40/636, 661.02, 661.04; 362/103, 108

See application file for complete search history.

(56) References Cited

U.S. PATENT DOCUMENTS 3,979,802 A * 9/1976 Bongartz ..... A44B 17/0052 24/630

5,440,461 A * 8/1995 Nadel ..... A41D 27/085 362/103

(Continued)

FOREIGN PATENT DOCUMENTS

| | | | |
|---|---|---|---|
| CA | 2631333 | * | 6/2018 |
| EP | 2 923 593 | * | 9/2015 |

*Primary Examiner* — Laura K Tso

(57) ABSTRACT

An emblem and assembly is provided for use with a leather garment. The emblem can include a decorative design on its surface. The assembly includes an inner support plate affixable with a section of the leather garment and an emblem base plate. The emblem base plate includes a first side for receiving at least one latching mechanism and a second side for receiving the emblem, wherein the latching mechanism couples with the inner support plate. The emblem base plate can include a hollowed out section on the second side with a circuit board with electrically coupled LED lighting attached thereto. The assembly can include an anchor plate affixable within an interior of the garment. The assembly can include a shoulder harness coupleable with the anchor plate and the inner support plate. The harness and inner support plate can be affixed at different positions along the anchor plate.

19 Claims, 6 Drawing Sheets

(51) Int. Cl.
*A41D 13/01* (2006.01)
*F21Y 115/10* (2016.01)

(56) References Cited

U.S. PATENT DOCUMENTS 5,636,385 A * 6/1997 Harrison ..... A41D 27/08 2/115
5,746,500 A * 5/1998 Chien ..... A43B 1/0036 36/137
6,178,680 B1 * 1/2001 Sloot ..... G09F 3/12 40/661.04
6,718,559 B1 * 4/2004 Davidson ..... A42B 3/0406 2/209.13
7,611,255 B1 * 11/2009 Lagassey ..... A42B 1/244 362/103
7,866,858 B2 * 1/2011 Hirzmann ..... B60R 13/005 362/487
8,590,185 B1 * 11/2013 Jardine ..... G09F 21/02 24/104
8,922,655 B2 * 12/2014 Forgue ..... B60R 19/52 224/309
8,998,451 B2 * 4/2015 Crognale ..... G09F 3/20 362/249.16
2006/0023468 A1 * 2/2006 Takahashi ..... B60R 13/005 362/555
2006/0126352 A1 * 6/2006 Kwon ..... B60Q 1/50 362/540
2006/0291233 A1 * 12/2006 Kwon ..... B60Q 1/50 362/540
2011/0051451 A1 * 3/2011 Stempinski ..... B60Q 1/50 362/545
2012/0099298 A1 * 4/2012 Hsu ..... A41D 27/085 362/103
2012/0182722 A1 * 7/2012 Wu ..... B60R 13/005 362/157
2013/0335997 A1 * 12/2013 Roberts ..... G09F 21/04 362/583
2014/0119038 A1 * 5/2014 Mulder ..... G09F 13/06 362/509
2014/0240999 A1 * 8/2014 Roberts ..... B60Q 1/2615 362/510
2014/0247614 A1 * 9/2014 Roberts ..... B60Q 1/2615 362/509
2014/0359919 A1 * 12/2014 O'Leary ..... A44C 3/001 2/244
2015/0138796 A1 * 5/2015 Salter ..... B60Q 1/0011 362/510
2015/0164154 A1 * 6/2015 Bencini ..... A41D 13/0531 2/455
2016/0015101 A1 * 1/2016 Stefanovic ..... A41D 27/08 2/244
2016/0201874 A1 * 7/2016 Stemmer ..... F21V 3/049 362/555

* cited by examiner

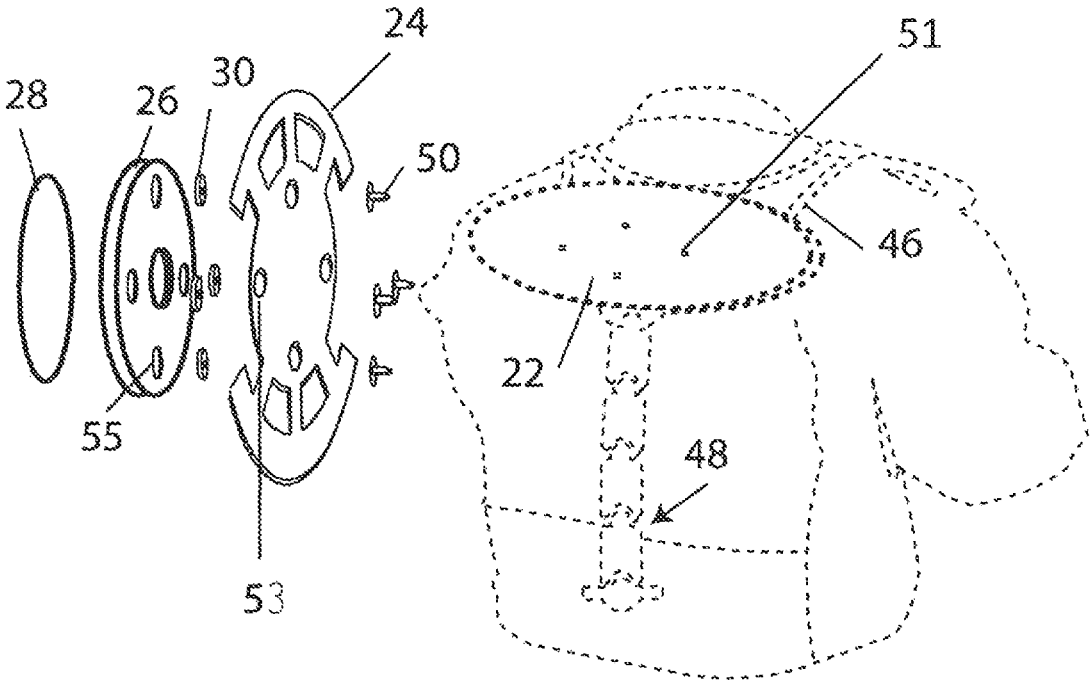
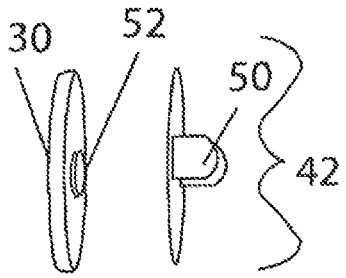
Figure 2
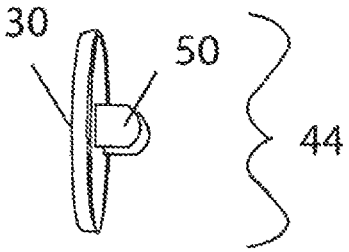

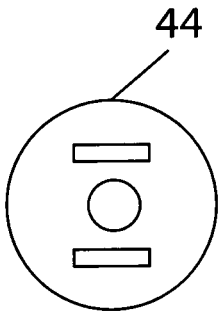
Figure 3
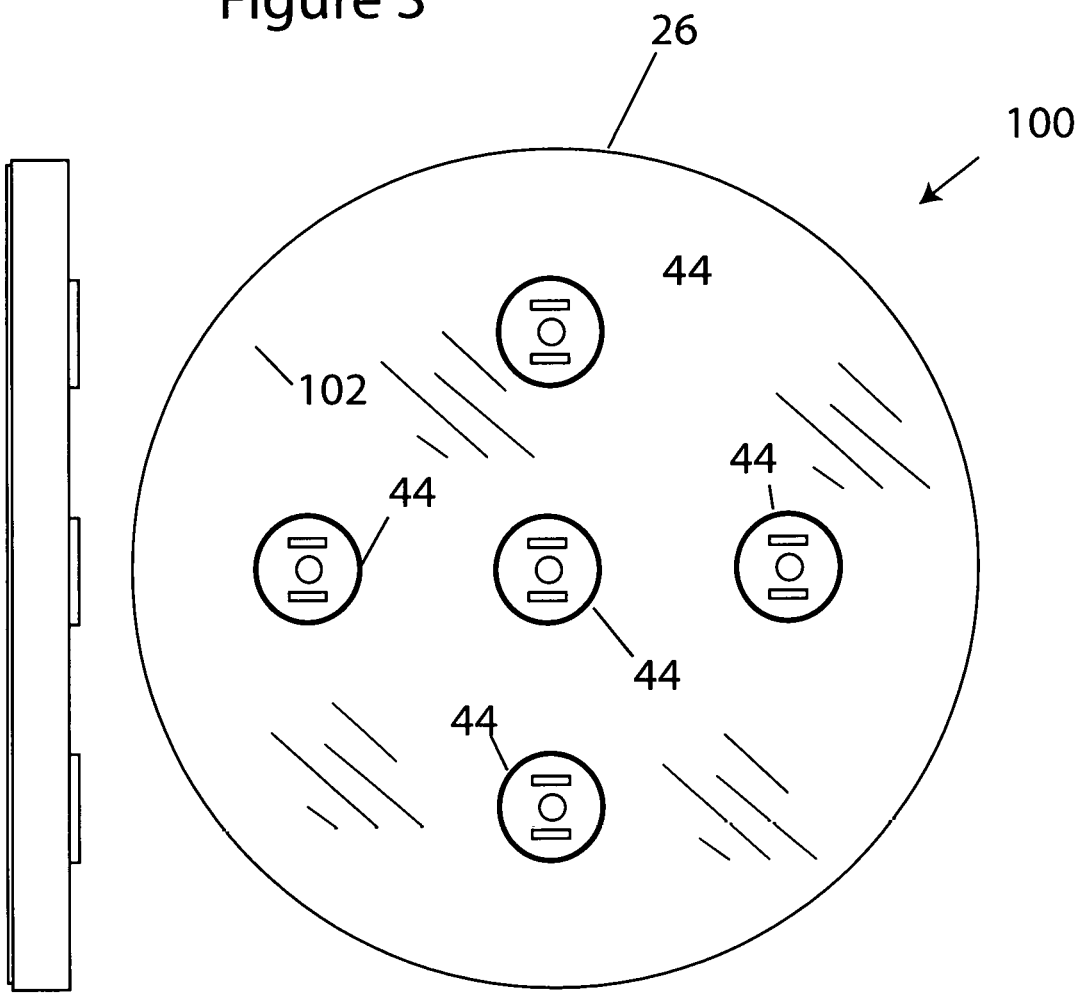

EMBLEM AND ASSEMBLY FOR WEARABLE CLOTHING

CROSS REFERENCE TO RELATED APPLICATION

This application claims priority to U.S. Provisional Patent Application No. 62/458,072 filed Feb. 13, 2017 and entitled "Magnetic Emblem and Assembly for Leather Jackets and Other Wearable Garments," the entire contents of which are hereby fully incorporated herein by reference for all purposes.

TECHNICAL FIELD OF THE DISCLOSURE

The present invention relates to the field of accessories for clothing and, more particularly, an emblem and associated assembly for wearable clothing, such as leather jacket.

BACKGROUND

Motorcycles and motorcycle parts, accessories, and garments are big business in the US and around the world. In fact, the motorcycle parts, accessories, and garments market is a billion dollar a year industry. As such, there are opportunities available to provide improvements to existing products and satisfy certain consumer needs. As an example, a consumer may spend $30,000.00 on an expensive, custom made motorcycle and another $1200.00 for expensive leather jacket, vest, and chaps. Often times, consumers like to decorate their leather jacket with patches that may represent a club they belong to or a hobby or interest they associate with. Currently, the options available are to decorate the expensive leather jacket with a cloth patch or patches that are sown into the leather and, hence, become essentially permanent features. This may not always be desirable.

SUMMARY

In a first aspect, the present disclosure is directed to an emblem and assembly for use with a leather garment. The emblem and assembly includes a emblem having a decorative design on a surface of the emblem; an inner support plate affixable with a section of the leather garment; and an emblem base plate having a first side for receiving at least one latching mechanism and a second side for receiving the emblem, wherein the latching mechanism couples with the inner support plate.

The emblem base plate can also include a hollowed out section on the second side. The emblem base plate can also include a circuit board. The emblem base plate can also include an LED lighting arrangement controlled by the circuit board. The circuit board can also include a processor and software for processing and communicating electronic data. The emblem and assembly can also include an anchor plate affixable within an interior of the garment. The emblem and assembly can also include a shoulder harness coupleable with the anchor plate and the inner support plate, wherein the shoulder harness and inner support plate can be affixed at different positions along the anchor plate. The emblem and assembly can also include a spine insert coupleable with the anchor plate, wherein the spine insert can be affixed at different positions along the anchor plate. The emblem and assembly can also include a shoulder harness coupled with the inner support plate. The emblem and assembly can also include a spine insert coupleable with the inner support plate.

In a second aspect, the present disclosure is directed to a leather garment having a emblem assembly. The leather garment includes a leather body wherein the leather body includes sections for receiving the emblem and assembly; a emblem having a decorative design on a surface of the emblem; an inner support plate affixable with a section of the leather garment; and an emblem base plate having a first side for receiving at least one latching mechanism and a second side for receiving the emblem, wherein the latching mechanism couples with the inner support plate.

The emblem base plate can include a hollowed out section on the second side. The emblem base plate can include a circuit board. The emblem base plate can include an LED lighting arrangement controlled by the circuit board. The circuit board ran include a processor and software for processing and communicating electronic data. The leather garment can also include an anchor plate affixable within an interior of the garment. The leather garment can also include a shoulder harness coupleable with the anchor plate and the inner support plate, wherein the shoulder harness and inner support plate can be affixed at different positions along the anchor plate. The leather garment can also include a spine insert coupleable with the anchor plate, wherein the spine insert can be affixed at different positions along the anchor plate. The leather garment can also include a shoulder harness coupled with the inner support plate. The leather garment can further include a spine insert coupleable with the inner support plate.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which:

FIG. 2 is another perspective view of the leather jacket and emblem and associated assembly, according to certain example embodiments;

FIG. 3 is a diagram of top and various cut-away views of a base plate of the emblem and associated assembly, according to certain example embodiments;

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. IL will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

One innovative aspect of the emblem and assembly presented herein is in essence a patch that can easily couple with the assembly and, therefore, be easily removed and replaced. Another innovative aspect of the associated assembly is the component parts can be easily integrated with a leather garment, such as a leather jacket, and it can further include a support frame that is designed to absorb the forces and maintain the position and alignment of the emblem and assembly when a user is riding a motorcycle, as an example. Other inventive aspects of the preferred embodiments will become apparent as discussions of the disclosure and drawings continue.

One benefit of the replaceable emblem is that if an establishment prohibits wearing certain colors or the advertisement of certain logos, the emblem can be easily removed and replaced. In the case of cloth patch sewn permanently into the jacket, the user would be prevented from entering the establishment unless the jacket were removed. As another example, perhaps the consumer enjoys certain music and decides to have a patch of a music bands logo sewn into the fabric of the jacket. Now the jacket permanently features that bands logos. That may be fine for a user riding a motorcycle but it may not be appropriate or desired for other venues.

Figure 1A:
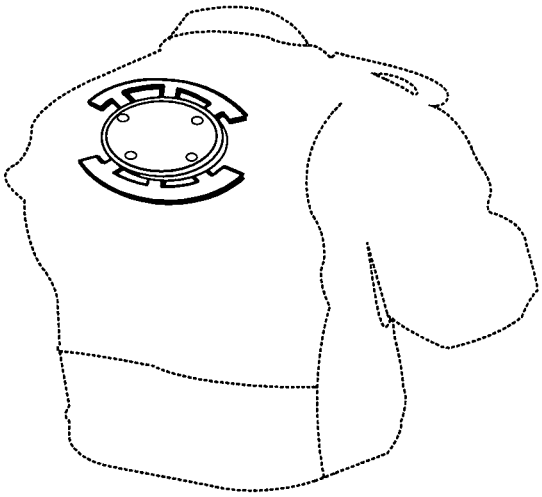
FIGS. 1A and 1B are first and second perspective views of a leather jacket and emblem and associated assembly, according to certain example embodiments.
Figure 1B:
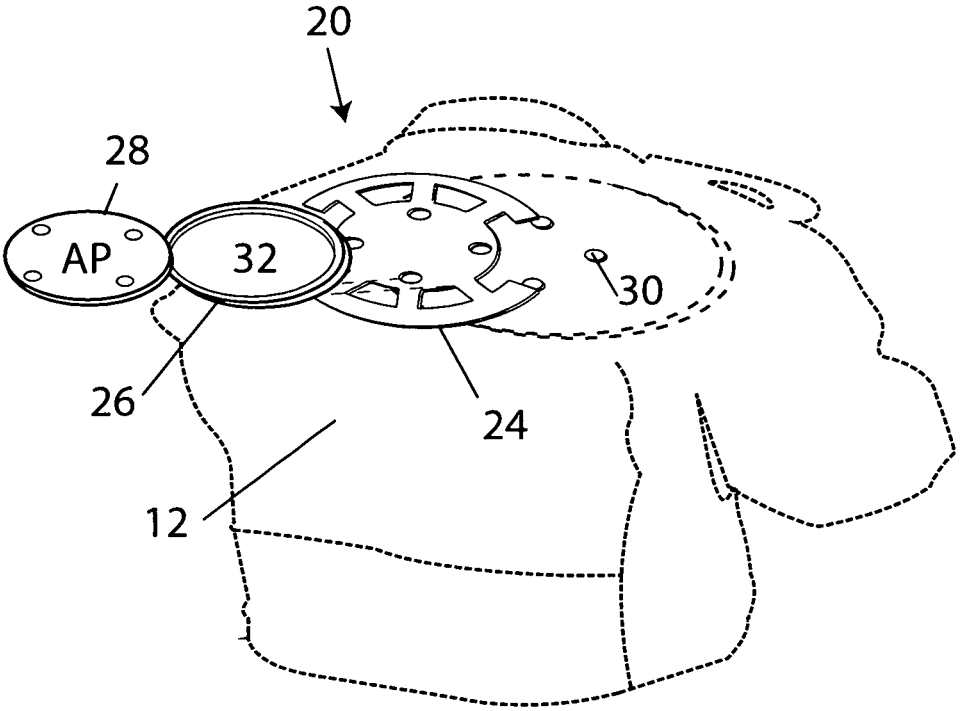

Referring to FIGS. 1A and 1B, illustrated are first and second perspective views of a leather jacket and emblem and associated assembly, according to certain example embodiments, denoted generally as 10 and 20, respectively. The emblem as defined throughout can refer to a raw metal piece where an etched or painted design can be placed or a plastics based piece where an etched or painted design can be placed. The emblem can be made of a light weight metal alloy or LEXAN™ resin which is a polycarbonate (PC) material and a trademark of SABIC GLOBAL TECHNOLOGIES B.V. The assembly is designed to easily couple with the emblem. The specifics of the associated assembly will become apparent.

FIG. 1A illustrates the emblem and associated assembly coupled with the leather jacket. FIG. 1B illustrates an exploded view of the emblem and associated assembly 12 and the leather jacket. In these embodiment and others presented herein, the emblem and associated assembly 12 can be physically and/or magnetically coupled together or physically coupled to the leather jacket, depending on the emblem type, alloy or plastics base. The leather jacket includes sections where the decorative emblem and assembly 12 can be applied. In this particular example, the emblem and assembly 12 are illustrated as being positioned across the upper back of the jacket. However, the emblem and assembly 12 can be placed anywhere and the emblem and assembly 12 can be of differing sizes and shapes to accommodate as to where the emblem and assembly 12 are to be placed. Furthermore, it should also be understood that although emblem and associated assembly 12 are described in reference to leather jackets the emblem and assembly 12 can also be used with other garments, such as a leather vest, denim, suede, or any material used in wearable items. It should be understood that the emblem and associated assembly 12, i.e. all its component parts, may be manufactured using metal alloys, plastics, glass, and any combination thereof.

In FIG. 1B, the emblem and assembly 12 includes an inner support plate 22, a decorative inner plate 24, although decorative inner plate 24 can be optional, an emblem base plate 26, and an emblem 28. The decorative inner plate 24 and the emblem 28 can include a custom design, such as a customized style frame, designed engraving, or painted coating. The support plate 22 can be positioned in the interior of the jacket and coupled to decorative plate 24 and emblem base plate 26 using latching mechanisms, see further description in FIG. 2 and FIG. 3 below. A latching mechanism can include a coupling head that can have a depth or width and/or magnetic properties that enables coupling with decorative plate 24 and base plate 26 and a pronged latching section that latches with an opposite side of the support plate 22 securing the support plate 22 and other parts to the jacket. In addition, the jacket or the support plate 22 can include a lining or padded lining, not illustrated, stitched around the inner support plate 22 so that when the jacket is worn the support plate 22 is not pressed directly against the wearer's back.

The decorative inner plate 24 can magnetically couple with the aforementioned coupling head 30 of the latching mechanism and/or simply be coupled by the application of the latching mechanism, as will become more readily apparent with respect to the description of the latching mechanism and FIG. 2. Optionally, the decorative plate 24 can include magnetic sections, e.g. sections of the decorative inner plate 24 can be manufactured to have magnetic properties and, therefore, the latches, or at least part of, would not need to be magnetized. Although, depending on the type of latch used the latch may not need to be magnetized at all. It also should be understood that the decorative inner plate 24 may be of a variety of designs; manufactured in a way to produce a design that can be appealing to certain consumer markets or simply for variety or to signify a company brand.

The emblem base plate 26 can be of any design, e.g. round, oval, or any other shape, and can include a recessed section 32. The recessed section 32 can serve to reduce the weight of base plate 28 and for storing an electronic circuit board that can include a processor and Operating System (OS) software. The electronic circuit board can control an LED lighting assembly and perform wireless communications and data processing. However, it should also be understood that the recessed section 32 may not be included. In this case, the emblem 28 can be a part of the emblem base plate 26 and manufactured as a single unit. In addition, the emblem base plate 26 can, optionally, have magnetic properties and be coupled with the decorative inner plate 24 using the latching mechanism.

The emblem 28 can be magnetically coupled to the base plate 26 or in the case of the use of LEXAN or similar type materials can be secured using other means, as one specific method of doing so will be described in reference to FIG. 3. Alternatively, the emblem 28 can be fixed to the emblem base plate 26 through other means, such as with fasteners, such as screws, or adhesives, or even welded. The face of the emblem 28 can include a custom design, e.g. a consumer can have a band's logo design included thereon. The emblem 28 can be manufactured using etched glass, etched metal, metal with a process color powder coat, or stained glass.

Referring to FIG. 2, illustrated is another perspective view of the leather jacket and emblem and associated assembly, according to certain example embodiments, denoted generally as 40. The jacket and emblem and assembly 40 can include inner support plate 22, decorative inner plate 24, emblem base plate 26, emblem 28, and latching mechanism 42 or latching mechanism 44. The jacket and emblem and associated assembly 40 can further include a harness 46 and spine insert 48. The harness 46, spine insert 48, and coupling mechanism, not illustrated, can be positioned in the interior of the jacket, e.g. sewn into the seem. The latching mechanism 42 includes coupling head 30 and fastener prongs 50. The latching mechanism 44 can include an integrated, i.e. single unit, coupling head 30 and fastener prongs 50. Integrated single unit in this sense meaning no separable coupling head 30.

With respect to support plate 22, decorative inner plate 24, base plate 26 and latching mechanisms 42, 44, the latching mechanisms can provide latching support for different emblem and associated assembly configurations. For example, with respect to the emblem and assembly configuration 12 wherein the decorative inner plate 24 is included, latching mechanism 42 can be advantageous in that the mechanism 42 coupled to the support plate 22 does not need to be removed in order to change design configurations. In other words, if a wearer would like to change decorative inner plate 24 for another plate with a different design, the fastener would not need to be removed or, stated differently, decoupled from the support plate 22. However, single unit latching mechanism 44 could also be used in this configuration. In an alternative scenario, wherein the decorative inner plate 24 is not included, the single unit latching mechanism 44 may be preferred to be coupled to the base plate 26 directly with the support plate 22. Although, obviously, latching mechanism 42 can also work in this configuration.

Support plate 22 and leather jacket can include strategically placed slots 51 for receiving fasteners 50 from latching mechanisms 42, 44. Decorative inner plate 24 and base plate 26 can include bored holes 53, 55 for receiving latching mechanisms 42 or 44. With respect to decorative inner plate 24, the holes 53 can be extend through the plate and with respect to the base plate 26 the holes 55 can be bored to a have a dimension suitable to secure the coupling head 30 when placed therein. For example, by forcing the latching mechanism 42 or into the hole 55, mechanism 44 can be secured due to frictional forces and magnetized forces. In one embodiment, a surface area of the decorative inner plate 24 facing the jacket can magnetically interface with a surface area of fastener 50 of latching mechanism 42 so that the surface area can be not only magnetically coupled with the inner plate 24 but also the coupling head 30. The coupling head 30 can include a male locking nipple 52 that can mate with a female receptacle of the fastener 50 from the other side of the plate 24 wherein the male/female nipple and receptacle can be coupled vis a vi magnetic coupling and/or stress based forces. Although the coupling head 30 can be optionally used. In another embodiment, latching mechanism 44 which is a single integrated unit that can interface with the decorative inner plate 24 on the opposite side of the decorative inner plate 24 facing the leather jacket. The latching mechanism 44 can couple the decorative inner plate 24 to the support plate 22 using the fasteners 50. The latching mechanisms 42, 44 can be made of metal alloys and/or plastics and can also be magnetized. In any case, the latching mechanism 42, 44 can interface, i.e. mate, with the bore holes 55 of base plate 26.

Figure 4:
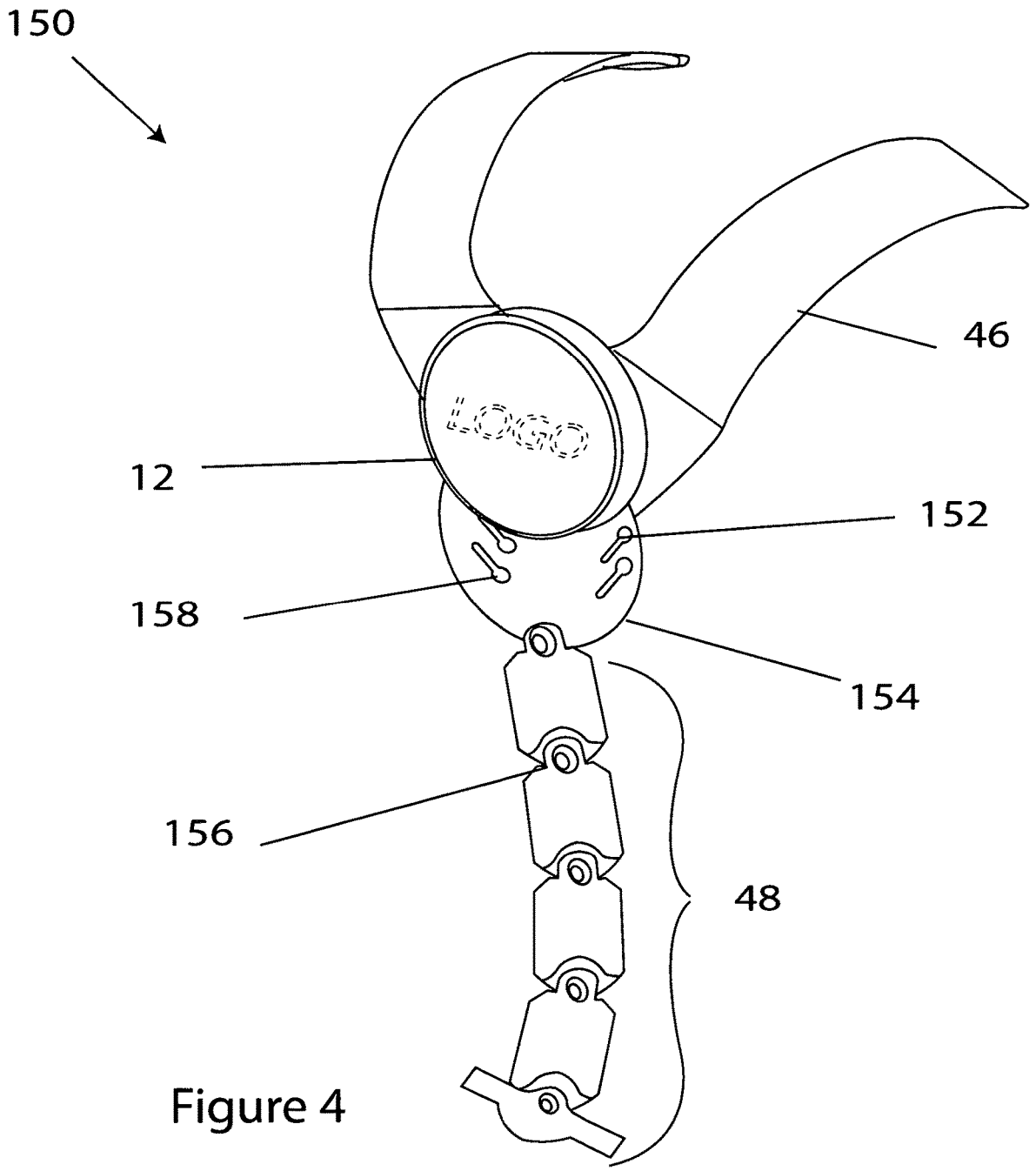
FIG. 4 is a perspective view of the emblem and associated assembly, a harness, a spine insert, and coupling means, according to certain example embodiments.
Figure 5:
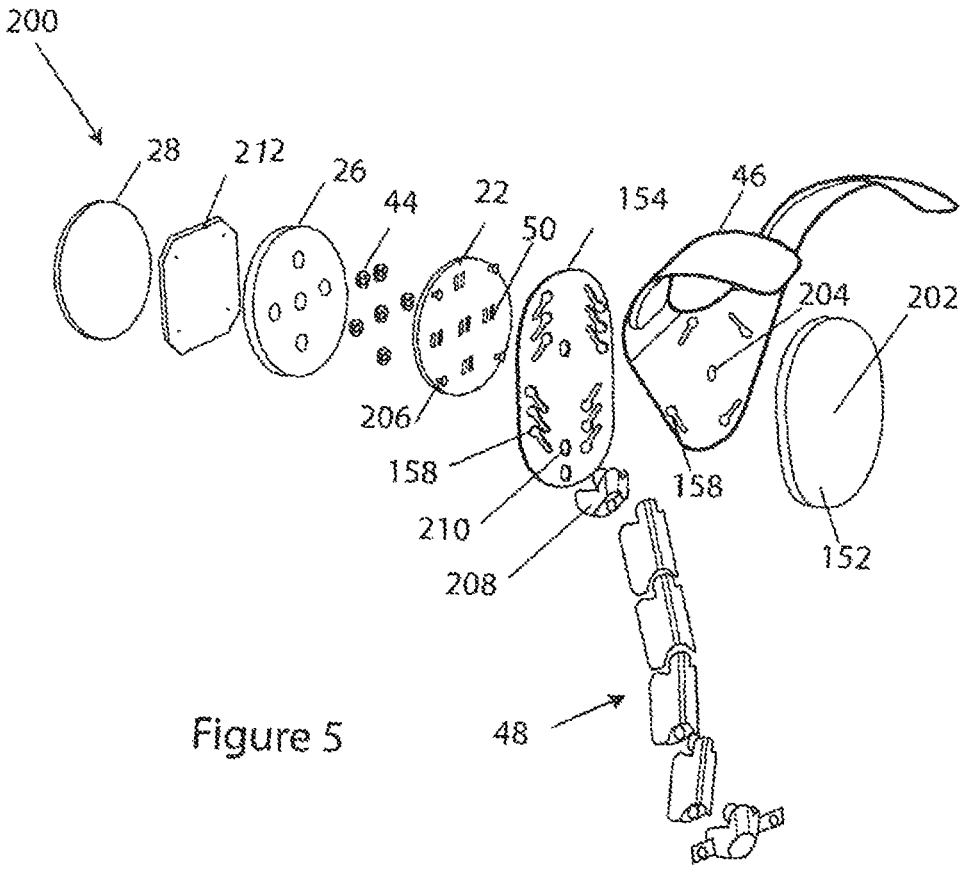
FIG. 5 is a perspective and exploded view of the emblem and associated assembly, harness, spine insert, and coupling means, according to certain example embodiments.

The emblem and assembly 12 can further include a harness 46 and spine insert 48 that couples together with the support plate 22 using a coupling means, see FIGS. 4 and 5 for more details. The idea behind the harness 46 and spine support is that traditionally motorcycle riders often wear leather jackets and with the use of some types of metal patches, i.e. emblems and assembly, there can be a need for a harness 46 and spine insert 48 to reduce some of the stress experienced with riding a motorcycle and wearing a leather jacket with a metal patch. The harness 46, support plate 22, coupling means, and spine insert 48 can be fitted in the lining of the leather jacket or outside the lining of the leather jacket. The harness 46 can fit over the shoulders of a wearer and the spine insert can either hang freely or coupled to the jacket using fasteners. The design elements included in the spine insert 48 is based on examples found in nature. The "lobster" tail uses overlapping discs, see FIGS. 4 and 5, assembled to provide a level of flexibility and stability that motorcycle riders do not experience without additional means of spinal support. In many cases, a rider is forced into positions while operating a motorcycle (especially with customized motorcycles where style is more important than comfort) that places stress in areas of the lower and mid back. By reinforcing the inside of the jacket in strategic locations, using tempered steel or certain high tensile strength alloys, this device can offset these negative side effects of improper position/spinal alignment by creating a supporting structure where there needs to be. The parts can be built upon demand and according to specifications the user provides, e.g. height and weight.

Referring now to FIG. 3, illustrated is a diagram of top and various cut-away views of base plate 26, according to certain example embodiments, denoted generally as 100. The base plate 26 is illustrated with the side facing the jacket to include a plurality of bored slots or holes for receiving and securing the latching mechanisms 44, although latching mechanisms 42 can also be used. In a typical use case, the latching mechanism would be forced into the slot where the dimensions of the plate 26 can secure it. The base plate 26 further includes a milled section 102, i.e. a channel or channels, formed along a hallowed out section on the opposite side of the base plate 22, depicted with perforated lines. The channel or channels can serve two functions. It can be used to receive and secure or house LED lighting and receive and secure a LEXAN™ based logo design. For example, a first channel formed can house the LED lighting and a second channel formed can secure the LEXAN™ based logo design. Alternatively, a formed channel can house the LED lighting and a surface of such can be used to couple with a metal type logo design, either magnetically coupling or physically coupling. LED lighting included in the channel can be electrically coupled with a circuit board, for example a battery powered circuit board. Although it should be understood that the dimensions illustrated is merely one of many possible designs.

Illumination can be a great benefit, e.g. to law enforcement. By using the emblem and assembly 12, with or without shoulder harness 46 and spine insert 48, the lighting characteristics can provide a measure of safety. In situations where there is little or no lighting, a motorcycle rider may become stranded on the side of the road creating a very dangerous, and in fact a life threatening situation. Most riders typically where black leather jackets and/or other dark clothing, combined with low light situations they are, for all intents and purposes, invisible to motorists. The illumination properties of the emblem 28 and base plate 26 provide a measure of visibility on the actual wearer, using built in Light Emitting Diodes (LEDs) or Electroluminescent Wires (EL). A battery located inside the enclosure provides the power source and can also be rechargeable. The lighting can be programmed via a small circuit board to light or flash in different sequences or flash to alternate between the different colored LED or EL wires. Rather than relying on other means to illuminate something in such a situation (for example: road flares, or the lights on the motorcycle, thus wearing down the battery), this method of illumination is personalized, and is of obvious benefit to the wearer as he/she is now illuminated and visible where before they were completely invisible Referring now to FIG. 4, illustrated is a perspective view of the emblem and associated assembly 12, harness 46, spine insert 48, and coupling means, according to certain example embodiments, denoted generally 150. On one side, the shoulder harness 46 can be attached through a coupling means to a protective cover 152. The harness 46 is designed to extend from anchor plate 154 upwards and over the shoulders to rest on top of the shoulders. This takes weight off the middle of the back, and also keeps emblem and assembly 12 from drooping due to its own weight. An added benefit of this being a more even weight distribution, and added comfort for the wearer. The harness straps can include padding. This harness 46 can also be made from KEVLAR, a para-aramid synthetic fiber and trademark of E.I. du Pont de Nemours and Company, thus providing a bullet resistant element to the part.

The protective cover 152 can be made of a metal alloy or plastic and can include a form of padding, such as rubber or cloth, to provide padding against the wearer's back. On the other side, the shoulder harness 46 can be attached to an anchor plate 154. The anchor plate 154 can be made of metal alloys or plastics and can include many fasteners and latching slots 156, 158 of differing type, e.g. male or female snap-on fasteners, BNC connector types typically used in electronics, latching pens and slots like that found in the use of bed frames, or simply nuts and bolts, screws or rivets, or other similar mechanisms. The coupling capabilities of the anchor plate 154 allows for the emblem and associated assembly 12, harness 46, and spine insert to be adjusted according to a wearer's height. The emblem and associated assembly 12 can be coupled to the anchor plate 154 using the many latching pens and slot configurations, or other suitable coupling means. The emblem and associated assembly 12, harness 46, spine insert 48 can be attached at different places along the anchor plate 154 in order to accommodate a rider's needs. Additionally, the number of discs 160 used can also be changed to accommodate certain wearer needs.

The spine insert 48 can be coupled to the anchor plate 154 using the snap-on fasteners, or other similar means. The spine insert 48 can be made of metal alloys or plastics or combination thereof. The spine insert 48 incorporates a system of upper and lower discs 160 acting as a quasi-exoskeleton. The discs 160 are coupled together using fasteners 156 so that interconnecting discs are allowed to independently move in multiple directions in response to a wearer' movement. These upper and lower discs 160 can be coupled with the anchor plate 154, making them stable and fixed into proper position. The Spine insert 48 extends from anchor plate 154 downwards the length of a person's spine, and provides comfort as well as keeping proper spine alignment. The "lobster tail" design element taking its cues from nature, provide a non-binding type of motion to absorb shock and provide stability with the right amount of flex and torsion. Additional benefit will be the protection from possible fracture of the spine due to sudden blunt force trauma. The device itself can be built out of KEVLAR material, thus providing a bullet resistant element to the part.

Referring now to FIG. 5, illustrated is a perspective and exploded view of the emblem and associated assembly 12, harness 46, spine insert 48, and coupling means, according to certain example embodiments, denoted generally 200. As is more clearly illustrated, protective cover 152 can be attached to the harness 46 using connector 202, a male connector, into the female counterpart 204 on the harness 46, although the male and female connectors could be reversed. The connector can be a plastic type of connector that couples using compresses forces and flange for holding the harness 46 and protective cover 152 in place. Additionally, BNC (Bayonet Neill-Concelman) style female/male connectors can be used. As can be seen, the harness 46 and anchor plate 154 includes a plurality of latching slots 158 for receiving and mating with latching pins 206. As can be further seen, the harness 48 can be coupled to the anchor plate 154 at different positions, e.g. based on specified requirements of the rider. The spine insert 48 can include a plurality of discs 160 that can be coupled together using plastic inserts, e.g., or BNC male/female type connectors, or other suitable coupling mechanisms. The top disc 208 of the spine insert 48 can be coupled with the anchor plate 154 at different positions 210 to further assist in providing a length that can accommodate wearer's of different heights.

The latching mechanisms 44 can be inserted in slots 51 and the prongs folded in a manner to secure the latching mechanisms 44 with the inner support plate 22. The coupling head of the latching mechanism can then be positioned into the base plate 26. As previously discussed, the latching mechanism 44 or base plate 26 can have magnetic properties to help secure coupling. An electronic circuit board 212, either processor/software based, an integrated circuit, or an analog circuit, can be secured to an interior section of the base plate 26 and the emblem 28 either magnetically or physically coupled with the base plate 26. As described in reference to FIG. 1B and FIG. 3, the circuit board 212 can be secured in the hollowed out section of the base plate 26, the LED lighting placed in a channel formed in the interior of the base plate 26, and the emblem 28 secured within a channel or magnetically or physically coupled to a surface of a channel.

It should also be understood that with the use of the anchor plate 154 the base plate 26 can be positioned within the interior of the jacket or garment or on the outside. In an embodiment, the inner support plate 22, anchor plate 154, harness 46, spine insert 48, and protective cover 152 can be affixed to the interior of the jacket or garment and the emblem base plate 26 and emblem 28 coupled thereto. Furthermore, the spine insert 48 can be optional. Additionally, in some embodiments, the anchor plate 154 may not be necessary and the harness 46 and spine insert 48 could couple directly with the inner support plate 22. In addition, although the protective cover 152, harness 46, anchor plate 154, spine insert 48, and support plate 22 have been described as separate pieces, the component parts can be manufactured as a single piece, or a subset of the components parts, e.g. using plastic injection molding.

Figure 6:
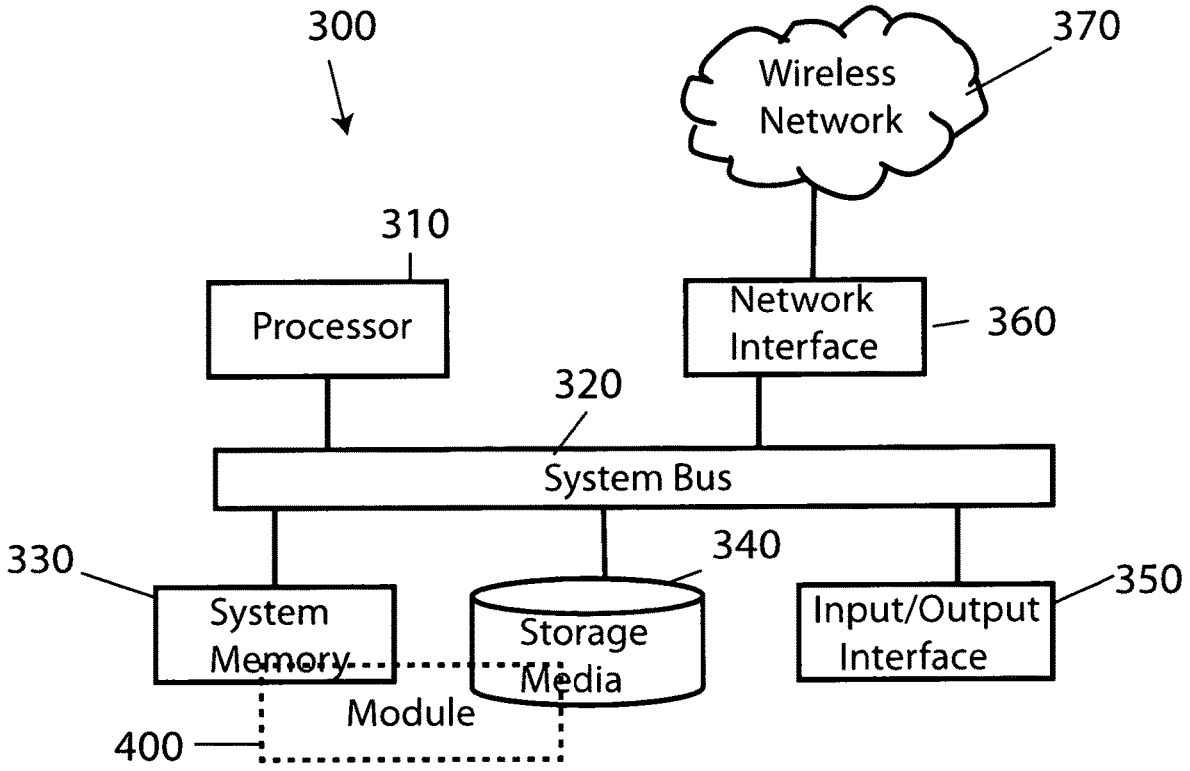
FIG. 6 is a computing machine and a system applications module, in accordance with example embodiments.

Referring now to FIG. 6, illustrated is a computing machine 300 and a system applications module 400, in accordance with example embodiments. The computing machine 300 can correspond to any of the various computers, mobile devices, laptop computers, servers, embedded systems, or computing systems presented herein. The module 400 can comprise one or more hardware or software elements, e.g. other OS application and user and kernel space applications, designed to facilitate the computing machine 300 in performing the various methods and processing functions presented herein. The computing machine 300 can include various internal or attached components such as a processor 310, system bus 320, system memory 330, storage media 340, input/output interface 350, a network interface 360 for communicating with a network 370, e.g. cellular/GPS.

The computing machines can be implemented as a conventional computer system, an embedded controller, a laptop, a server, a mobile device, a smartphone, a wearable computer, a customized machine, any other hardware platform, or any combination or multiplicity thereof. The computing machines can be a distributed system configured to function using multiple computing machines interconnected via a data network or bus system.

The processor 310 can be designed to execute code instructions in order to perform the operations and functionality described herein, manage request flow and address mappings, and to perform calculations and generate commands. The processor 310 can be configured to monitor and control the operation of the components in the computing machines. The processor 310 can be a general purpose processor, a processor core, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 310 can be a single processing unit, multiple processing units, a single processing core, multiple processing cores, special purpose processing cores, co-processors, or any combination thereof. According to certain embodiments, the processor 310 along with other components of the computing machine 300 can be a software based or hardware based virtualized computing machine executing within one or more other computing machines.

The system memory 330 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 330 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 330. The system memory 330 can be implemented using a single memory module or multiple memory modules. While the system memory 330 is depicted as being part of the computing machine, one skilled in the art will recognize that the system memory 330 can be separate from the computing machine 300 without departing from the scope of the subject technology. It should also be appreciated that the system memory 330 can include, or operate in conjunction with, a non-volatile storage device such as the storage media 340.

The storage media 340 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 340 can store one or more operating systems, application programs and program modules, data, or any other information. The storage media 340 can be part of, or connected to, the computing machine. The storage media 340 can also be part of one or more other computing machines that are in communication with the computing machine such as servers, database servers, cloud storage, network attached storage, and so forth.

The applications module 400 and other OS application modules can comprise one or more hardware or software elements configured to facilitate the computing machine with performing the various methods and processing functions presented herein. For example, provide control functions for controlling LED lighting sequences or control functions for controlling processing and communications of electronic data. The applications module 400 and other OS application modules can include one or more algorithms or sequences of instructions stored as software or firmware in association with the system memory 330, the storage media 340 or both. The storage media 340 can therefore represent examples of machine or computer readable media on which instructions or code can be stored for execution by the processor 310. Machine or computer readable media can generally refer to any medium or media used to provide instructions to the processor 310. Such machine or computer readable media associated with the applications module 400 and other OS application modules can comprise a computer software product. It should be appreciated that a computer software product comprising the applications module 400 and other OS application modules can also be associated with one or more processes or methods for delivering the applications module 400 and other OS application modules to the computing machine via a network, any signal-bearing medium, or any other communication or delivery technology. The applications module 400 and other OS application modules can also comprise hardware circuits or information for configuring hardware circuits such as microcode or configuration information for an FPGA or other PLD. In one exemplary embodiment, applications module 400 and other OS application modules can include algorithms capable of performing the functional operations described by the flow charts and computer systems presented herein.

The input/output ("I/O") interface 350 can be configured to couple to one or more external devices, to receive data from the one or more external devices, and to send data to the one or more external devices. Such external devices along with the various internal devices can also be known as peripheral devices. The I/O interface 350 can include both electrical and physical connections for coupling the various peripheral devices to the computing machine or the processor 310. The I/O interface 350 can be configured to communicate data, addresses, and control signals between the peripheral devices, the computing machine, or the processor 310. The I/O interface 350 can be configured to implement any standard interface, such as small computer system interface ("SCSI"), serial-attached SCSI ("SAS"), fiber channel, peripheral component interconnect ("PCI"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 350 can be configured to implement only one interface or bus technology. Alternatively, the I/O interface 350 can be configured to implement multiple interfaces or bus technologies. The I/O interface 350 can be configured as part of, all of, or to operate in conjunction with, the system bus 320. The I/O interface 350 can include one or more buffers for buffering transmissions between one or more external devices, internal devices, the computing machine, or the processor 320.

The I/O interface 320 can couple the computing machine to various input devices including mice, touch-screens, scanners, electronic digitizers, sensors, receivers, touchpads, trackballs, cameras, microphones, keyboards, LED devices any other pointing devices, or any combinations thereof. The I/O interface 320 can couple the computing machine to various output devices including video displays, speakers, printers, projectors, tactile feedback devices, automation control, robotic components, actuators, motors, fans, solenoids, valves, pumps, transmitters, signal emitters, lights, and so forth.

The computing machine 300 can operate in a networked environment using logical connections through the NIC 360 to one or more other systems or computing machines across a network. The network can include wide area networks (WAN), local area networks (LAN), intranets, the Internet, wireless access networks, wired networks, mobile networks, telephone networks, optical networks, or combinations thereof. The network can be packet switched, circuit switched, of any topology, and can use any communication protocol. Communication links within the network can involve various digital or an analog communication media such as fiber optic cables, free-space optics, waveguides, electrical conductors, wireless links, antennas, radio-frequency communications, and so forth.

The processor 310 can be connected to the other elements of the computing machine or the various peripherals discussed herein through the system bus 320. It should be appreciated that the system bus 320 can be within the processor 310, outside the processor 310, or both. According to some embodiments, any of the processors 310, the other elements of the computing machine, or the various peripherals discussed herein can be integrated into a single device such as a system on chip ("SOC"), system on package ("SOP"), or ASIC device.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions unless otherwise disclosed for an exemplary embodiment. Further, a skilled programmer would be able to write such a computer program to implement an embodiment of the disclosed embodiments based on the appended flow charts, algorithms and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. An emblem and assembly for use with a leather garment, the assembly comprising:

a metal emblem having a decorative design on a surface of the emblem;

an inner support plate affixable with a section of the leather garment; and an emblem base plate having:

a first side for receiving at least one latching mechanism; and a second side for receiving the metal emblem;

wherein the latching mechanism couples with the inner support plate;

wherein the emblem base plate includes a circuit board.

2. The emblem and assembly of claim further comprising a enclosed, recessed section between the metal emblem and the emblem base plate.

3. The emblem and assembly of claim 1 wherein the emblem base plate includes an LED lighting arrangement controlled by the circuit board.

4. The emblem and assembly of claim 1 wherein the circuit board includes a processor and software for processing and communicating electronic data.

5. The emblem and assembly of claim 1 further comprising an anchor plate affixable within an interior of the garment.

6. The emblem and assembly of claim 5 further comprising a shoulder harness coupleable with the anchor plate and the inner support plate, wherein the shoulder harness and inner support plate can be affixed at different positions along the anchor plate.

7. The emblem and assembly of claim 5 further comprising a spine insert coupleable with the anchor plate, wherein the spine insert can be affixed at different positions along the anchor plate.

8. The emblem and assembly of claim 1 further comprising a shoulder harness coupled with the inner support plate.

9. The emblem and assembly of claim 1 further comprising a spine insert coupleable with the inner support plate.

10. A leather garment having an emblem and associated assembly, the leather garment comprising:

a leather body wherein the leather body includes sections for receiving the metal emblem and assembly;

an emblem having a decorative design on a surface of the emblem;

an inner support plate affixable with a section of the leather garment; and an emblem base plate having a first side for receiving at least one latching mechanism and a second side for receiving the emblem, wherein the latching mechanism couples with the inner support plate;

wherein the emblem base plate includes a circuit board.

11. The leather garment as recited in claim 10 further comprising a enclosed, recessed section between the metal emblem and the emblem base plate.

12. The leather garment of claim 11 wherein the emblem base plate includes an LED lighting arrangement controlled by the circuit board.

13. The leather garment of claim 11 wherein the circuit board includes a processor and software for processing and communicating electronic data.

14. The leather garment of claim 10 further comprising an anchor plate affixable within an interior of the garment.

15. The leather garment of claim 14 further comprising a shoulder harness coupleable with the anchor plate and the inner support plate, wherein the shoulder harness and inner support plate can be affixed at different positions along the anchor plate.

16. The leather garment of claim 14 further comprising a spine insert coupleable with the anchor plate, wherein the spine insert can be affixed at different positions along the anchor plate.

17. The leather garment of claim 10 further comprising a shoulder harness coupled with the inner support plate.

18. The leather garment of claim 10 further comprising a spine insert coupleable with the inner support plate.

19. An emblem assembly, the assembly comprising:

a metal emblem having a decorative design on a surface of the emblem;

an inner support plate affixable with a section of a garment; and an emblem base plate having:

a first side for receiving at least one latching mechanism; and a second side for receiving the metal emblem;

wherein the latching mechanism couples with the inner support plate;

wherein the metal emblem and the emblem base plate form an enclosed, recessed section.

* * * * *